US007866994B1

(12) United States Patent
Yang et al.

(10) Patent No.: US 7,866,994 B1
(45) Date of Patent: Jan. 11, 2011

(54) CARD CONNECTOR

(75) Inventors: Chih-Ling Yang, Tu-Cheng (TW); Sheng-Nan Yu, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/634,639

(22) Filed: Dec. 9, 2009

(51) Int. Cl.
*H01R 13/62* (2006.01)

(52) U.S. Cl. ..... 439/153; 439/630

(58) Field of Classification Search ..... 439/153, 439/157, 159, 160, 630
See application file for complete search history.

(56) References Cited

U.S. PATENT DOCUMENTS 6,899,555 B2 * 5/2005 Nagata et al. ..... 439/159
7,070,451 B2 * 7/2006 Nagata ..... 439/630
7,484,977 B2 * 2/2009 Hsiao ..... 439/160
7,537,486 B2 * 5/2009 Hong et al. ..... 439/626

* cited by examiner

*Primary Examiner*—Khiem Nguyen
(74) *Attorney, Agent, or Firm*—Cheng-Ju Chiang

(57) ABSTRACT

The card connector includes an insulating housing, a plurality of terminals received by the insulating housing, an ejector mechanism having a slider disposed at a side of the insulating housing, a lock member fixed on the slider, having a retention arm, a free end of the retention arm formed a projection for inserting into the gap of the inserted electronic card, a top side of the retention arm having a portion adjacent to the hook projecting upwards to form a lock piece and a shielding shell. The shielding shell has a guide groove which includes a slot extending frontward and rearward, a front end of an outer side of the slot being enlarged outwards to form a trough, wherein the lock piece is restrained in a rear end of the slot opposite to the trough and can move outwards in the trough of the guiding groove.

7 Claims, 7 Drawing Sheets

CARD CONNECTOR

BACKGROUND OF THE INVENTION

1. Field of the Invention

The present invention relates to a card connector, and particularly to a card connector capable of holding an electronic card therein firmly.

2. The Related Art

With the ever-increasing miniaturization and multifunction of portable electronic devices, such as digital cameras, PDAs and the like, a variety of electronic cards are used to increase the capacity of the portable electronic devices. A lot of card connectors for receiving the electronic cards are designed.

The card connector is generally involved with an insulating housing, a plurality of terminals mounted in the insulating housing for electrically connecting with an electronic card, an ejector mechanism assembled at a side of the insulating housing, and a shielding shell coupled with the insulating housing. When the user needs to eject the electronic card from the card connector, an outer force is acted upon the ejector mechanism so that the electronic card can be withdrawn from the card connector under the drive of the ejector mechanism.

U.S. Pat. No. 7,484,977, for example, discloses a card connector comprising an insulating housing, a plurality of terminals received in the insulating housing, a shell covering on the insulating housing and an ejector mechanism which has a slider and a lock device assembled on a side of the insulating housing. The lock device includes a lock member which inserts into a gap of the electronic card for holding the electronic card. However, because the lock member holds the electronic card only by means of elastic deformation thereof, the electronic card is apt to move in the card connector, even depart from the card connector by a greater and unexpected vibration or a drop test.

SUMMARY OF THE INVENTION

Accordingly, an object of the present invention is to provide a card connector which can hold an electronic card firmly. The card connector for receiving an inserted electronic card which has a gap at a side thereof from a front to rear direction includes an insulating housing, a plurality of terminals received in the insulating housing, an ejector mechanism has a slider disposed at a side of the insulating housing, a lock member fixed to the slider and a shielding shell covering on the insulating housing to define a receiving space for receiving the electronic card. The lock member has a retention arm and a free end of the retention arm formed a projection for inserting into the gap of the inserted electronic card for preventing the electronic card from moving. A top side of the retention arm has a portion adjacent to the projection projecting upwards to form a lock piece. The shielding shell has a guide groove which has a slot extending frontward and rearward, parallel to an inserting direction of the electronic card, for receiving the lock piece. A front end of an outer side of the slot is enlarged outwards to form a trough. When the electronic card is in a locked state, the lock piece is restrained in a rear end of the slot opposite to the trough, for preventing the hook from disengaging from the gap of the electronic card, when the electronic card is ejected from the receiving space, the lock piece moves into the trough from the slot, for allowing the hook to move outwards and disengage from the gap of the electronic card.

As described above, when the electronic card is in a locked state, the lock piece is moved to the rear end of the slot opposite to the trough and is restrained in the slot. The projection inserts in the gap of the electronic card continuously, so the card connector holds the electronic card firmly. When the electronic card is ejected from the receiving space, the lock piece is moved into the trough from the slot. The projection can move outwards and disengage from the gap of the electronic card. So the electronic card can be removed from the card connector easily.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
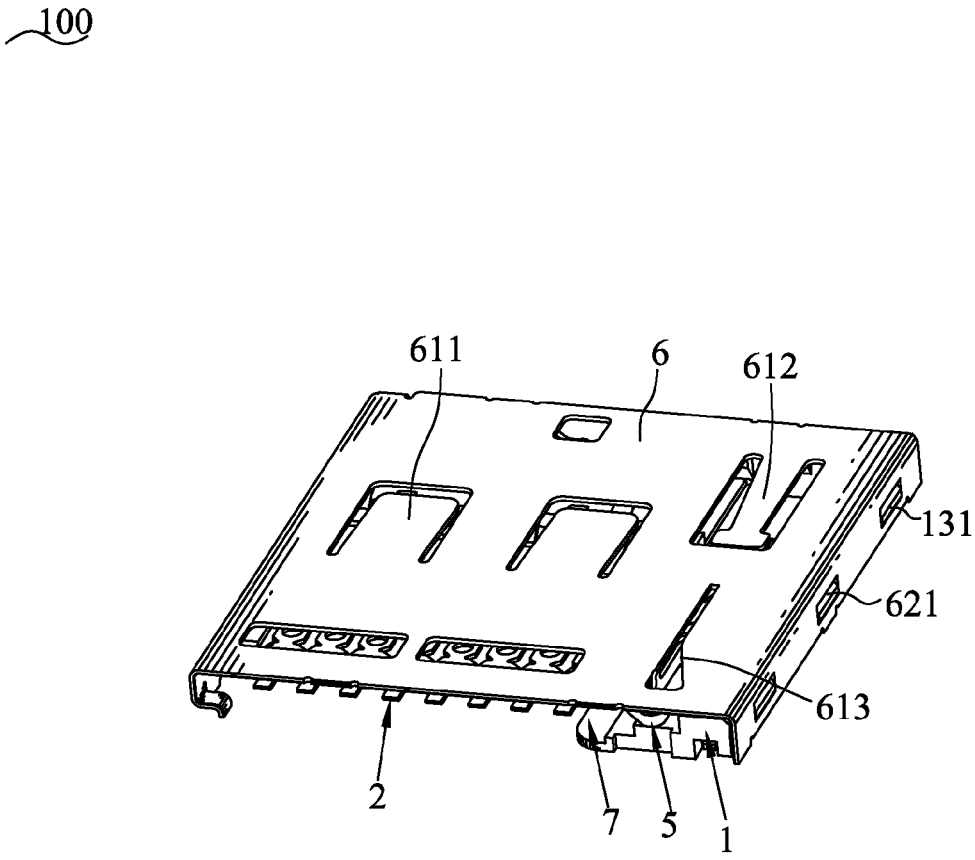
FIG. 1 is a perspective view of a card connector of an embodiment in accordance with the present invention.

Reference will now be made to the drawing figures to describe the present invention in detail.

Figure 2:
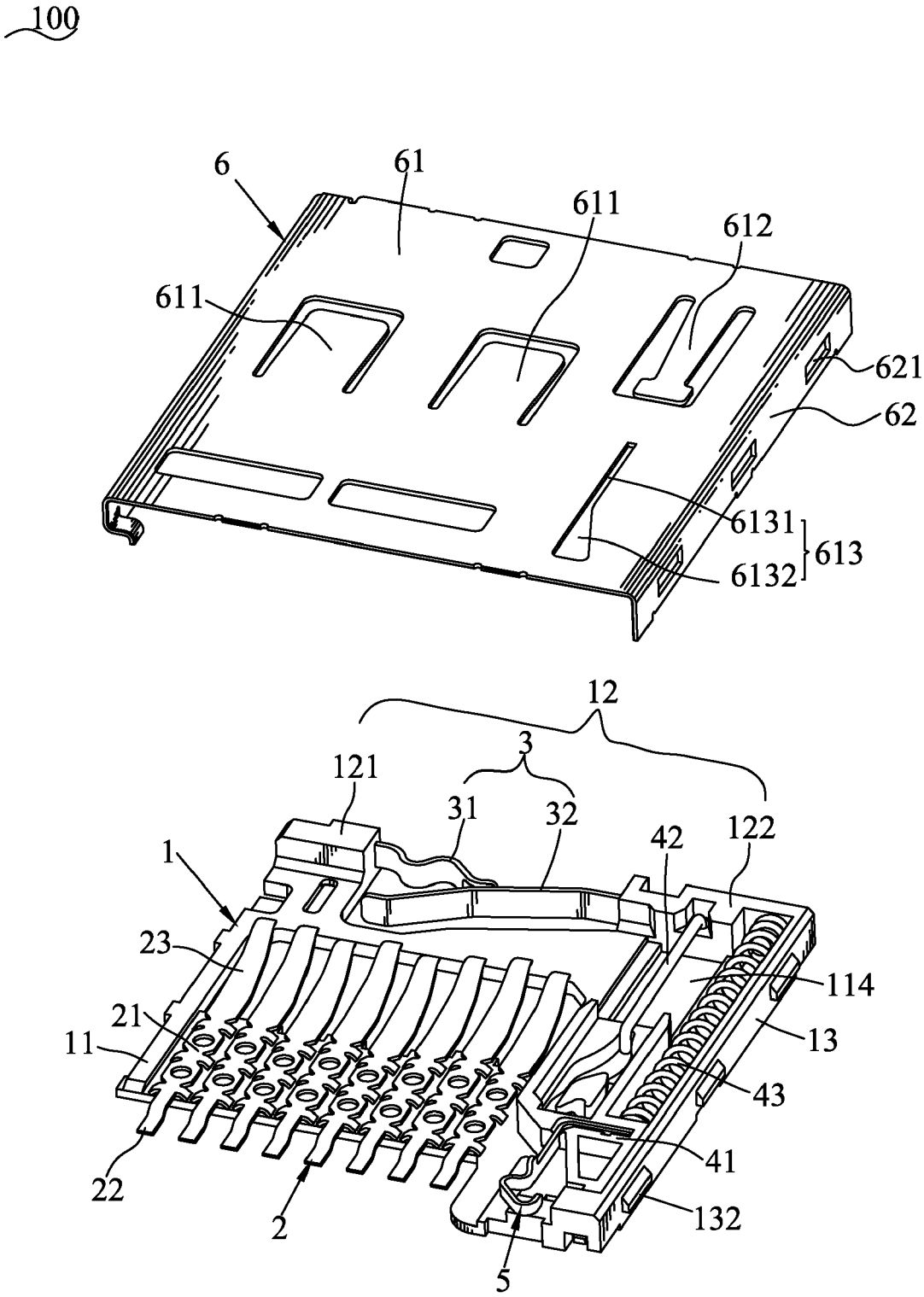
FIG. 2 is a perspective view of the card connector shown in FIG. 1, wherein an insulating housing 1 is uncovered by a shielding shell.
Figure 3:
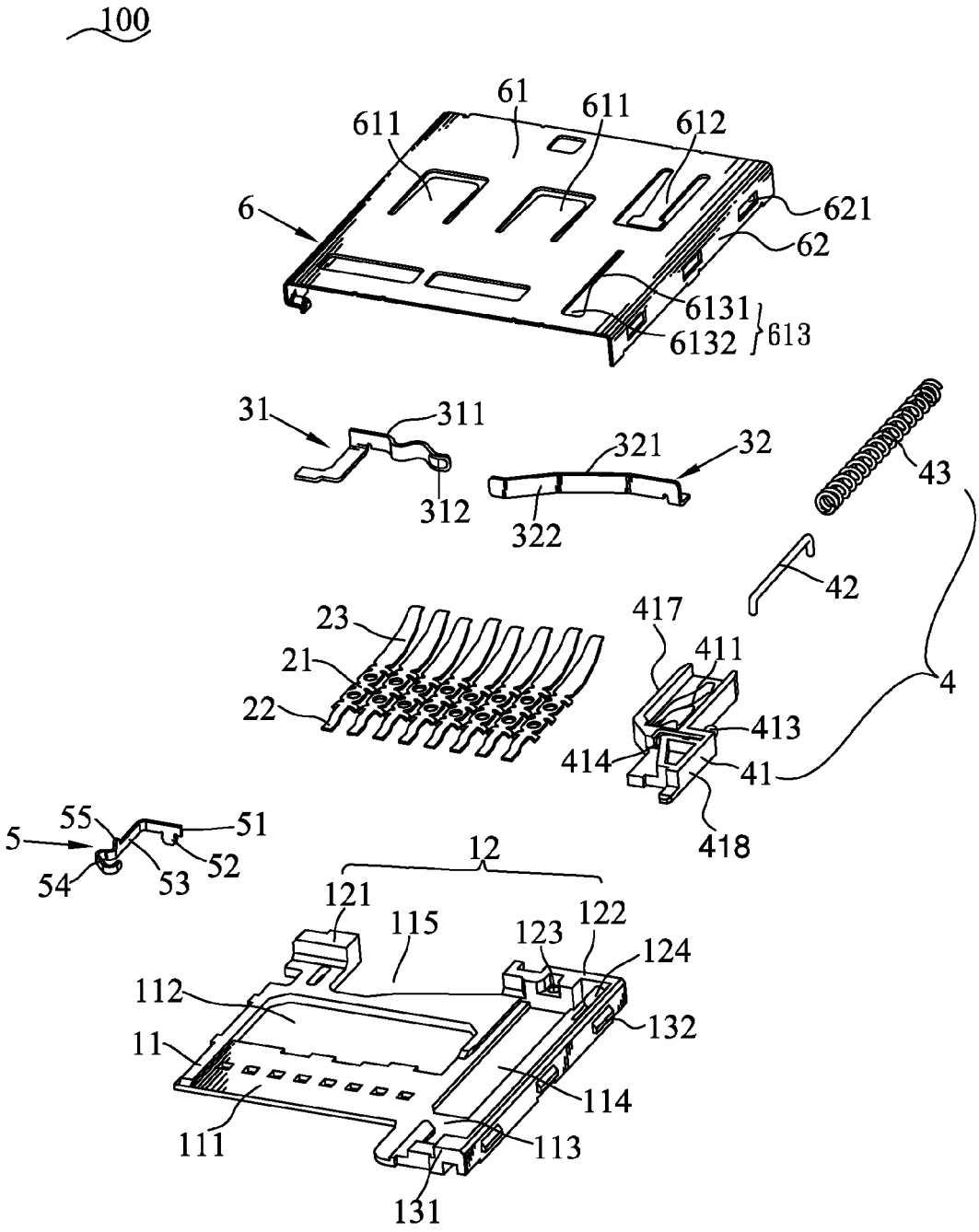
FIG. 3 is an exploded, perspective view of the card connector shown in FIG. 1.

Please refer to FIGS. 1-3, a card connector 100 for connecting with an electronic card 200 (shown in FIG. 7) comprises an insulating housing 1, a plurality of terminals 2 received in the insulating housing 1, a shielding shell 6 covering on the insulating housing 1, with a receiving space 7 formed therebetween for receiving the electronic card 200, an ejector mechanism 4 disposed at a side of the insulating housing 1, and a lock member 5 fixed to a slider 41 of the ejector mechanism 4.

Figure 4:
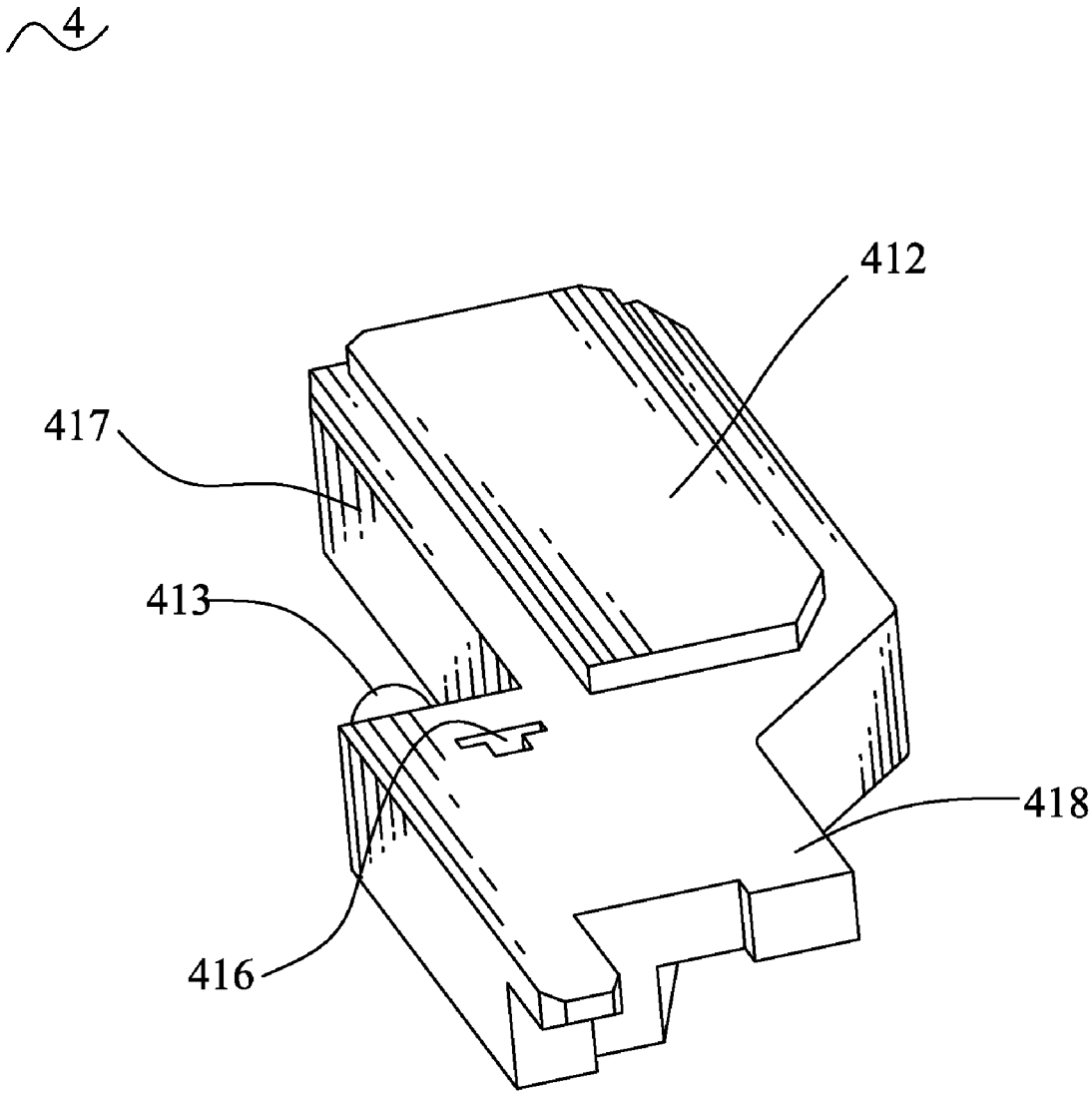
FIG. 4 is a perspective view of a slider of the card connector shown in FIG. 2.

Please refer to FIGS. 2-4, the insulating housing 1 comprises a base 11, a first wall 12 extending upwardly from a rear end of the base 11 and a second wall 13 extending upwardly from a side of the base 11. The second wall 13 has a stopping block 131 extending inwards from a front end thereof. A plurality of bulges 132 extends laterally from an outer surface of the second wall 13. The first wall 12 has a notch 115 at a substantially middle portion thereof, dividing the first wall 12 into a first part and a second part, designated 121 and 122 respectively. The second part 122 adjacent to the second wall 13 has a hole 123 and a fixing post 124 disposed between the hole 123 and the second wall 13. The fixing post 124 extends frontward from a front surface of the first wall 12. A space 113 is surrounded by the second part 122 of the first wall 12, the second wall 13 and the stopping block 131. A rectangle chute 114 is substantially formed at a bottom of the space 113 and extends frontward and rearward. The base 11 has a through-hole 112 at a center thereof. A depression 111 is disposed in front of the through-hole 112.

The ejector mechanism 4 has a slider 41, a cam follower 42 and a spring element 43. The slider 41 has a first part 417 and a second part 418 connected with a front end of the first part 417 and biased from the first part 417. The first part 417 has a heart cavity 411 at a top surface thereof, and a bump 412 at a bottom surface thereof. The second part 418 has a retraining slot 414 at a portion of a top surface thereof adjacent to the first part 417. The retraining slot 414 extends along a direction substantially perpendicular to an inserting direction of the electronic card 200. A substantially middle portion of a bottom of the retraining slot 414 has an extension slot 416 reaching a bottom of the second part 418. A rear end of the second part 418 is extended rearwards to form a guide post 413. The cam follower 42 is made of a metal bar with two free ends bent towards the same direction. The slider 41 is disposed in the space 113 of the insulating housing 1, with the bump 412 movably received in the chute 114. The cam follower 42 has one free end inserted into and moving along the heart groove 411, and the other free end inserted in the hole 123 of the first wall 12. The spring element 43 is arranged between the slider 41 and the first wall 12, with two free ends positioned by the post 124 and the guide post 413, respectively.

The plural terminals 2 are disposed at the depression 111 of the insulating housing 1. Each of the terminals 2 comprises a retention portion 21, a contact portion 23 extending outwards from one free end of the retention portion 21 for contacting the inserted electronic card 200, and a solder portion 22 extending outwards from the other free end of the retention portion 21 for being soldered on a printed circuit board (PCB, not shown). The contact portion 23 extends into the receiving space 7 and is located above the through-hole 112 for receiving the pressed contact portion 23 for reducing the deformation.

The lock member 5 comprises a retention arm 53 and a holding arm 51 extending perpendicularly from one free end of the retention arm 53 to show an L shape. The holding arm 51 has an extension piece 52 at a bottom side thereof, corresponding to the extension slot 416. The other end of the retention arm 53 is arched to form a V-shaped hook 54, with a point thereof pointing towards a direction opposite to the holding arm 51, for inserting into a gap 201 of the electronic card 200 (shown in FIG. 7). A top side of the retention arm 53 has a portion adjacent to the hook 54 projecting upwards to form a lock piece 55. The holding arm 51 of the lock member 5 is disposed in the retaining slot 414 of the slider 41, with the extension piece 52 buckled with the extension slot 416 for fixing the lock member 5 to the slider 41.

The shielding shell 6 is covered on the insulating housing 1 with a plurality of corresponding fastening holes 621 to match with the bulges 131 of the insulating housing 1. The shielding shell 6 made of metal has a main plate 61 and a pair of lateral portions 62 extending downwards from two opposite sides of the main plate 61. The main plate 61 has a plurality of pressing slices 611 for pressing the inserted electronic card 200, and an elastic cantilever 612 corresponding to the cam follower 42. The main plate 61 also has a guiding groove 613 disposed in front of the elastic cantilever 612 corresponding to the lock piece 55 of the lock member 5. The guiding groove 613 includes a slot 6131 extending frontward and rearward. A front end of an outer side of the slot 6131 is enlarged outwards to form a trough 6132. In this embodiment, the slot 6131 is a rectangle slot and the width of the slot 6131 is slightly wider than that of the lock piece 55. The width of the trough 6132 gradually increases from rear to front to show a triangle shape. So the lock piece 55 is restrained in the slot 6131 and can move outwards in the trough 6132.

Figure 5:
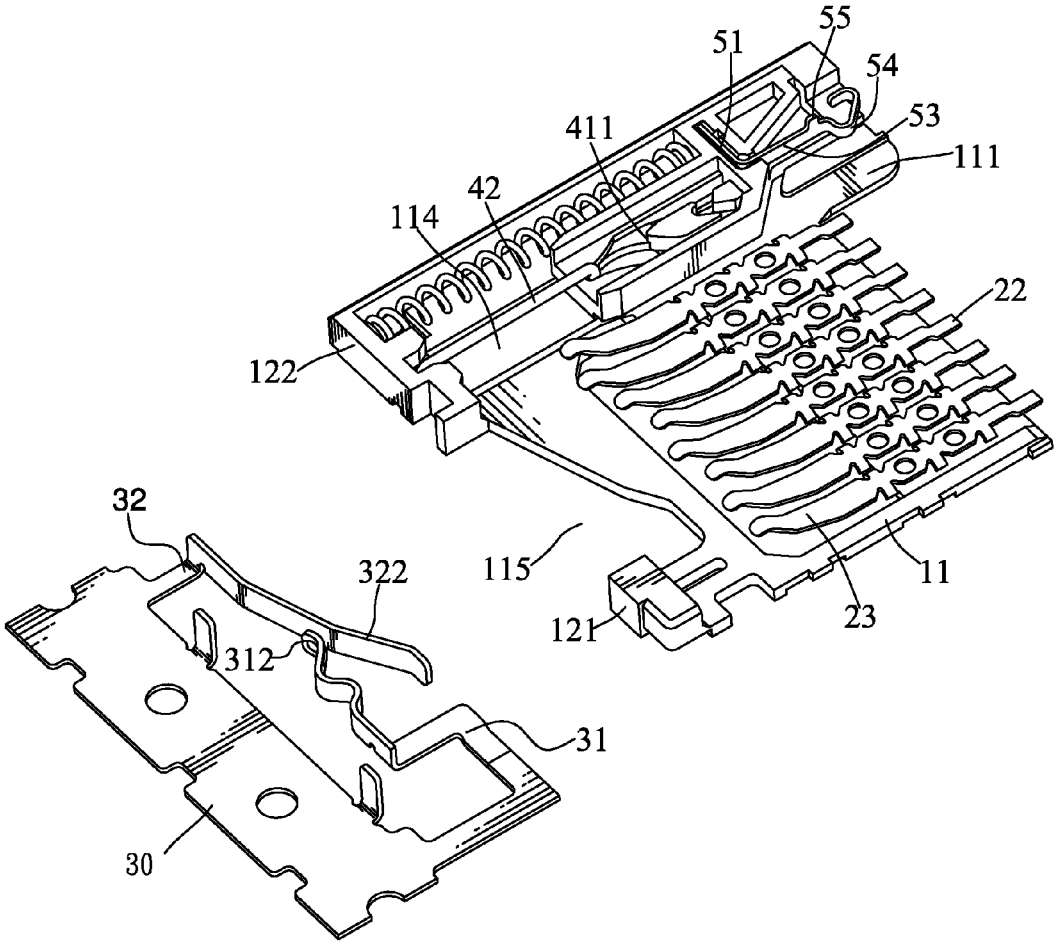
FIG. 5 is a partial view of the card connector shown in FIG. 2.

Please refer to FIG. 2, FIG. 3 and FIG. 5, the card connector 100 further comprises a set of detection terminals 3 including a first terminal 31 and a second terminal 32. The first terminal 31 and the second terminal 32 are integrally molded in the first part 121 and the second part 122 of the first wall 12 respectively. The first terminal 31 has a first contact arm 311 and a first contact end 312 extends from a free end of the first contact arm 311. Similarly, the second terminal 32 has a second contact arm 321 and a second contact end 322 extending from a free end of the second contact arm 321. The second contact end 322 of the second terminal 32 is disposed forward of the first contact end 312 of the first terminal 31, and extends into the receiving space 7. For ensuring the accuracy of the relative position between the first terminal 31 and the second terminal 32, the first terminal 31 and the second terminal 32 are formed by stamping and cutting a metal sheet 30. Then, the first terminal 31 and the second terminal 32, connected with each other, are integrally molded in the first part 121 and second part 122 of the first wall 12. The portion of the metal sheet 30 exposing outside the insulating housing 1 is removed. When an electronic card 200 is fully inserted into the card connector 100, the second contact end 322 is pushed to move rearward to contact with the first contact end 312 for connecting an external detection circuit (not shown).

Figure 6:
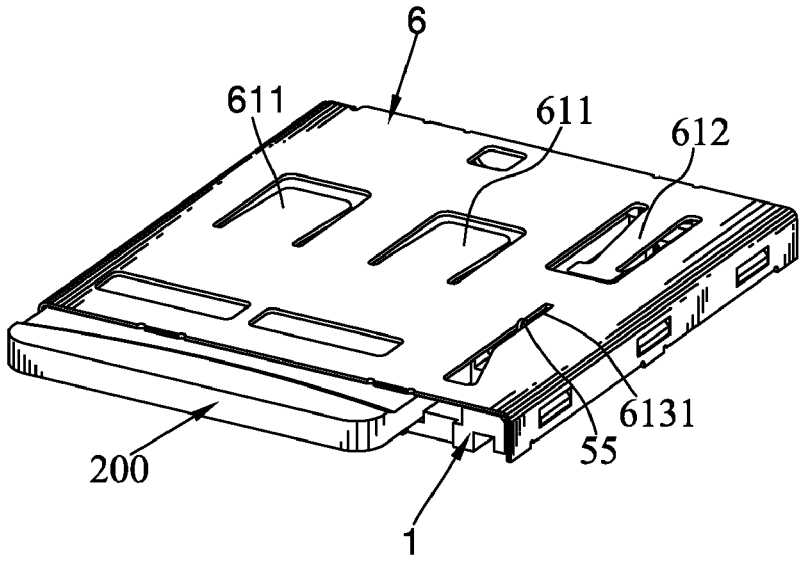
FIG. 6 is an assembly, perspective view of the card connector of FIG. 1 in a locked state.
Figure 7:
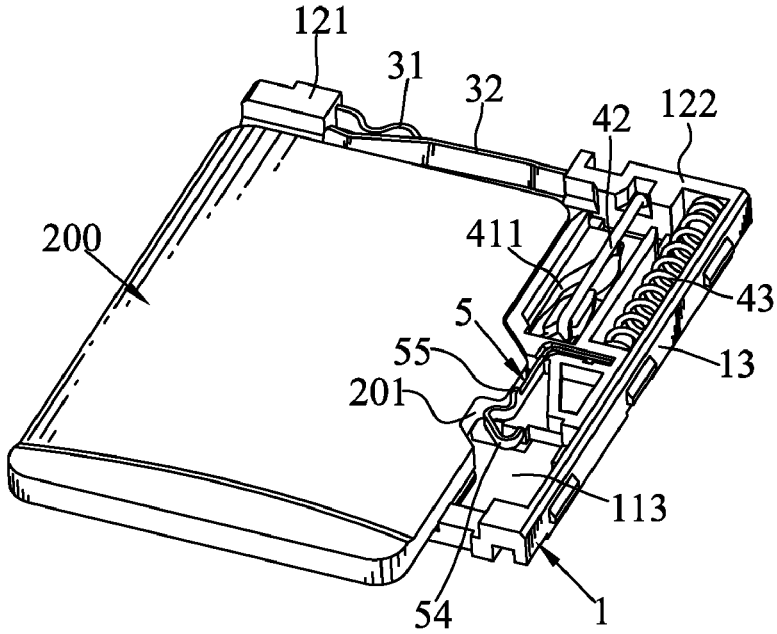
FIG. 7 is a perspective view of the card connector of FIG. 6, wherein the shielding shell is removed.

Please refer to FIG. 6 and FIG. 7, an electronic card 200 received in the receiving space 7 has a gap 201 at a side thereof. When the electronic card 200 is inserted into the receiving space 7 completely, the electronic card 200 pushes the slider 41 to move rearward along the chute 114 of the insulating housing 1. The lock member 5 moves rearward with the slider 41. The spring element 43 is compressed and the hook 54 inserts into the gap 201 of the electronic card 200. The lock piece 55 of the lock member 5 moves into the slot 6131 of the guide groove 613, defined as a locked state. The pressing slices 611 press on the electronic card 200 to make it connect with the terminals 2 completely. The elastic cantilever 612 presses on the cam follower 42 to keep the cam follower 42 retaining in the heart groove 411. When the card connector 100 is subjected to a greater vibration or a drop test, the electronic card 200 tends to escape from the card connector 100 and the electronic card 200 presses the hook 54 to move outwards. The slot 6131 of the guiding slot 613 allows the lock piece 55 to move along the inserting direction of the electronic card 200 only, so the hook 54 is kept in the gap 201 of the electronic card 200 because of the engagement of the lock piece 55 restrained in the slot 6131.

Figure 8:
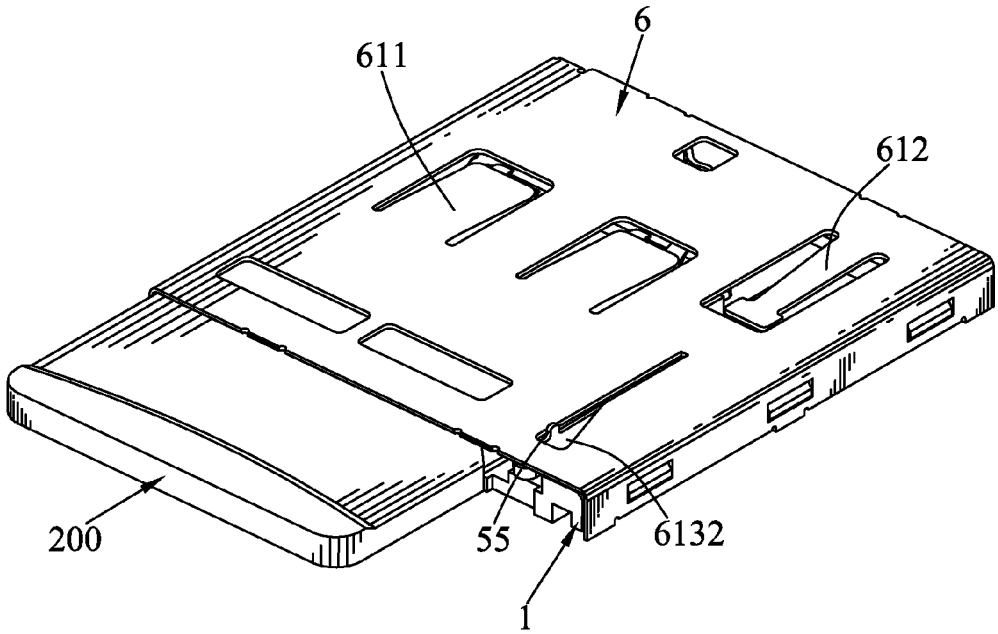
FIG. 8 is an assembly, perspective view of the card connector of FIG. 1 in an ejected state.
Figure 9:
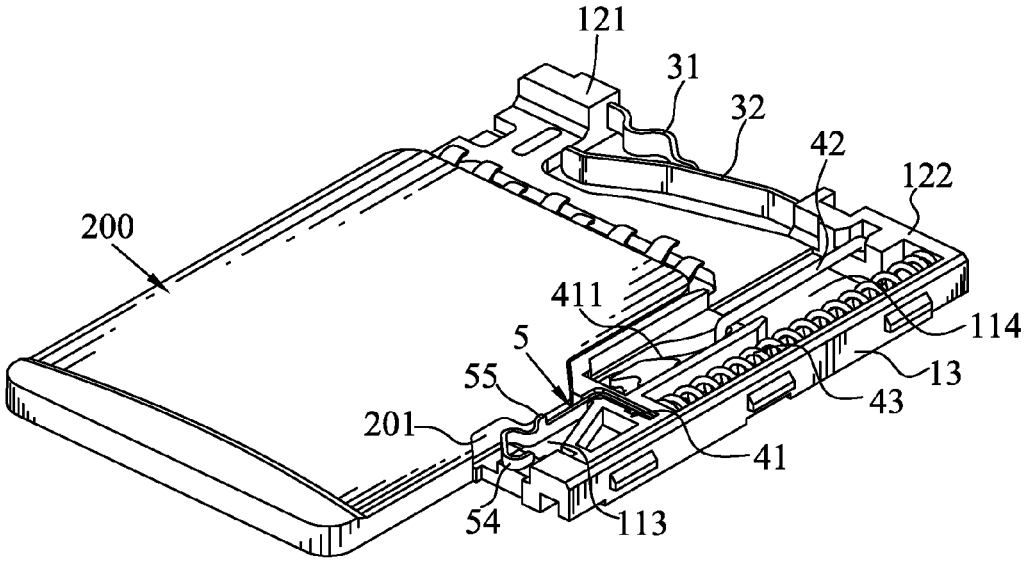
FIG. 9 is a perspective view of the card connector of FIG. 8, wherein the shielding shell is removed.

Please refer to FIG. 8 and FIG. 9, when the user wants to eject the electronic card 200, the electronic card 200 is applied with a pushing force. The cam follower 42 is disengaged from the heart groove 411 and slides frontward because of the stored elastic force of the spring element 43. The lock piece 55 of the lock member 5 moves frontward with the slider 41 and comes into the front end of the guide groove 613. Because the trough 6132 allows the lock piece 55 to move along the direction perpendicular to the inserting direction of the electronic card 200, the hook 54 of the lock member 5 can move outward freely, so the card 200 can be removed from the card connector 100 easily.

As described above, when the card connector 100 is in the locked state, the lock piece 55 is restrained in the slot 6131 of the guide groove 613, preventing the lock piece 55 from moving laterally. So the hook 54 is inserted into the gap 201 of the electronic card 200 firmly, avoiding the electronic card 200 being withdrawn from the card connector 100. When the card connector 100 is in an ejected state, the lock piece 55 is in the trough 6132 of the guide groove 613. As the trough 6132 allows the lock piece 55 to move along the direction perpendicular to the inserting direction of the electronic card 200, the electronic card 200 can be removed from the card connector 100 easily in the ejected state.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A card connector for receiving an inserted electronic card which has a gap at a side thereof from a front to rear direction, comprising:

an insulating housing;

a plurality of terminals received in the insulating housing;

an ejector mechanism disposed at a side of the insulating housing, the ejector mechanism having a slider received in the insulating housing and movable frontward and rearward with respect to the insulating housing;

a lock member fixed to the slider, the lock member having a retention arm, a free end of the retention arm formed a projection for inserting into the gap of the inserted electronic card for preventing the electronic card from moving, a top side of the retention arm having a portion adjacent to the hook projecting upwards to form a lock piece; and a shielding shell covering on the insulating housing to define a receiving space for receiving the electronic card, the shielding shell having a guide groove which has a slot extending frontward and rearward, parallel to an inserting direction of the electronic card, for receiving the lock piece, a front end of an outer side of the slot being enlarged outwards to form a trough;

wherein when the electronic card is in a locked state, the lock piece is restrained in a rear end of the slot opposite to the trough, for preventing the hook from disengaging from the gap of the electronic card, when the electronic card is ejected from the receiving space, the lock piece is moved into the trough from the slot, for allowing the hook to move outwards and disengage from the gap of the electronic card.

2. The card connector as claimed in claim 1, wherein the insulating housing has a first wall extending upwardly from a rear of a base thereof, a notch is formed at a middle portion of the first wall to divide the first wall into two parts, two detection terminals are respectively fixed in the two parts.

3. The card connector as claimed in claim 2, wherein the detection terminals are integrally molded with the insulating housing, the detection terminals have a first terminal and a second terminal, the first terminal has a first contact arm located in the notch, the second terminal has a second contact arm located in the notch and disposed forward of the first contact arm for being pressed by the inserted electronic card to connect with the first contact arm.

4. The card connector as claimed in claim 1, wherein the slider has a retaining slot, the lock member has a holding arm which is fixed in the retaining slot for fixing the lock member to the slider.

5. The card connector as claimed in claim 4, wherein a bottom of the retaining slot has an extension slot at a middle thereof, the holding arm has an extension piece extending downwardly from a middle of a bottom side thereof for inserting into the extension slot.

6. The card connector as claimed in claim 1, wherein the width of the trough gradually increases from rear to front to show a triangle shape.

7. The card connector as claimed in claim 1, wherein the projection is a hook arched inward at the free end of the retention arm.

* * * * *